United States Patent [19]

Meloy

[11] Patent Number: 4,605,534

[45] Date of Patent: Aug. 12, 1986

[54] CLEANING AND DISINFECTING SYSTEMS INCLUDING COLOR DISPLAY MEANS

[75] Inventor: Gilbert K. Meloy, Cincinnati, Ohio

[73] Assignee: Twinoak Products, Inc., Plano, Ill.

[21] Appl. No.: 545,876

[22] Filed: Nov. 2, 1983

[51] Int. Cl.[4] ..... E03D 9/02; A61L 2/16

[52] U.S. Cl. ..... 422/37; 4/227; 4/228; 4/DIG. 9

[58] Field of Search ..... 4/227, 228, DIG. 9; 422/28, 37, 266

[56] References Cited

U.S. PATENT DOCUMENTS

| | | | |
|---|---|---|---|
| 4,248,827 | 2/1981 | Kitko | 422/37 |
| 4,281,421 | 8/1981 | Nyquist et al. | 422/261 |
| 4,353,866 | 10/1982 | Wong | 422/37 |

*Primary Examiner*—Ivars Cintins

*Attorney, Agent, or Firm*—McDougall, Hersh & Scott

[57] ABSTRACT

A process for detecting the depletion of a cleaning and disinfecting ingredient in a solution such as the water present in a toilet tank and bowl. A solid composition comprising a color indicator in a matrix is located in the solution along with the ingredient. The porosity of the solid composition is maintained within limits to provide a means for controlling the rate of release of the color indicator into the solution. The cleaning and disinfecting ingredient has a bleaching tendency relative to the color indicator so that a display of color is minimal or non-existent for as long as significant amounts of the ingredient are present. The color indicator is provided in sufficient amounts so that, when considering the controlled rate of release, there will be continued release of color indicator after depletion of the ingredient. This will then provide a substantial display of color whereby depletion of the ingredient can be detected.

7 Claims, 4 Drawing Figures

CLEANING AND DISINFECTING SYSTEMS INCLUDING COLOR DISPLAY MEANS

BACKGROUND OF THE INVENTION

Aqueous calcium hypochlorite mixtures are used for various cleaning and disinfecting purposes, including germ control in swimming pools and disinfecting of toilet bowls and tanks. In many of these uses, it is helpful to include a color indicator in the hypochlorite mixture which will indicate when the hypochlorite concentration is reduced to a level such that the cleaning/disinfecting properties become ineffective or only marginally effective.

Sytems for indicating color are incorporated in dispensers disclosed in U.S. Pat. No. 4,171,546 issued to Dirksing, U.S. Pat. No. 4,200,606 issued to Kitko, U.S. Pat. No. 4,208,747 issued to Dirksing, and U.S. Pat. No. 4,216,027 issued to Wages. The Kitko '605 disclosure discusses a system wherein a dye is provided for giving a persistent color to the bowl water between flushes of the toilet. The objective is to assure a consumer that the bowl is being sanitized and means are provided to indicate the time when the disinfectant needs to be replaced. This is accomplished by controlling the quantities of $Ca(OCl)_2$ and color indicator, contained in separate chambers, so that the source of the color indicator is exhausted at about the time the calcium hypochlorite is nearly exhausted.

Other toilet tank dispensers for calcium hypochlorite mixtures have no provisions for indicating by means of color. For example, U.S. Pat. No. 3,837,017 issued to McDuffee discloses a passive system for cleaning toilet bowls wherein a container for calcium hypochlorite is located within a water tank associated with the bowl. A small diameter opening is provided within the top wall of the container to provide exposure to water in the tank so that the compound will be dissolved in the water and thereby delivered to the bowl when the toilet is flushed. An amount of inert particles, such as stone, may be included in the container to cooperate with the small diameter opening for purposes of limiting the rate of removal of the compound from within the container.

Meloy application Ser. No. 364,786, filed Apr. 2, 1982, and Meloy application Ser. No. 385,454, filed June 7, 1982, disclose various dispensers containing indicator systems wherein hypochlorite or the like esentially bleaches out the color capability of a selected dye for as long as the hypochlorite is present in sufficient amounts. When the hypochlorite amounts are at or near exhaustion, the dye will provide a color signal indicating that a new dispenser is required.

SUMMARY OF THE INVENTION

The present invention relates to a method and composition for efficiently indicating the presence of sufficient amounts of a disinfecting and/or cleaning ingredient in an aqueous mixture. The invention will be described with reference to aqueous hypochlorite solutions or the like which are commonly used in conjunction with toilet tanks and bowls, swimming pools and waste treatment facilities. The aforementioned Meloy applications provide an outline of known solutions of this type. It will be appreciated, however, that the concepts of this invention are applicable to chemical compositions and environments not directly or indirectly referenced herein.

The composition of this invention generally involves the use of a solid composition of matter containing a solubilizing agent, a matrix agent, and a color indicator. The composition is structured to retain its size and shape when immersed in an environment of the type including an aqueous mixture of calcium hypochlorite or the like. In use, the color indicator is adapted to be released at a controlled rate.

The characteristics of the cleaning and disinfecting ingredient on the one hand, and of the color indicator on the other hand, are such that the latter is all or substantially all bleached out for as long as efficacious amounts of the former are present. Under these circumstances, a substantially clear solution is dispensed during each toilet flush, however, when the former ingredient is depleted to below efficacious levels, the bleaching capability is lost. The amount of color indicator employed is sufficient so that amounts of this indicator are still present and a color signal appears. The user is then alerted to the need for changing the dispenser to provide a fresh supply of cleaning and disinfecting ingredient.

The invention is more particularly related to control of the porosity of the tablet or other form assumed by the color indicator. Thus, it has been found that the rate of release of the color indicator can be controlled when the porosity is within desired limits. By utilizing sufficient color indicator in the tablet or the like, and by calculating the life of the cleaning and disinfecting ingredient in the system, a color signal can be reliably provided on an efficient basis.

DESCRIPTION OF THE PREFERRED EMBODIMENT

Figure 1:
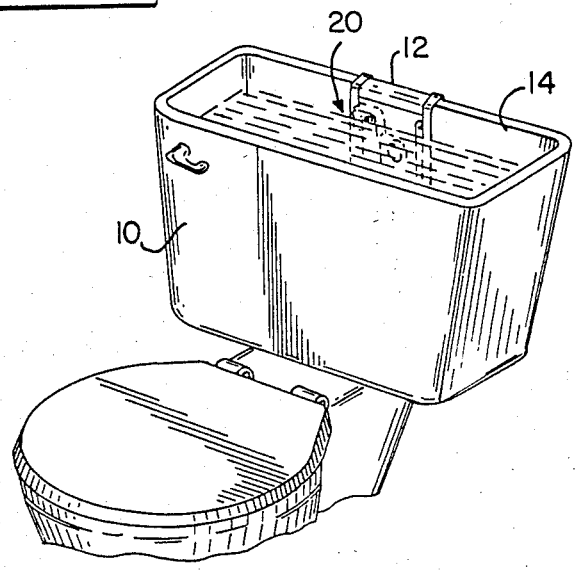
FIG. 1 is a fragmentary perspective view showing a dispenser for a cleaning and disinfecting ingredient associated with a toilet tank.
Figure 2:
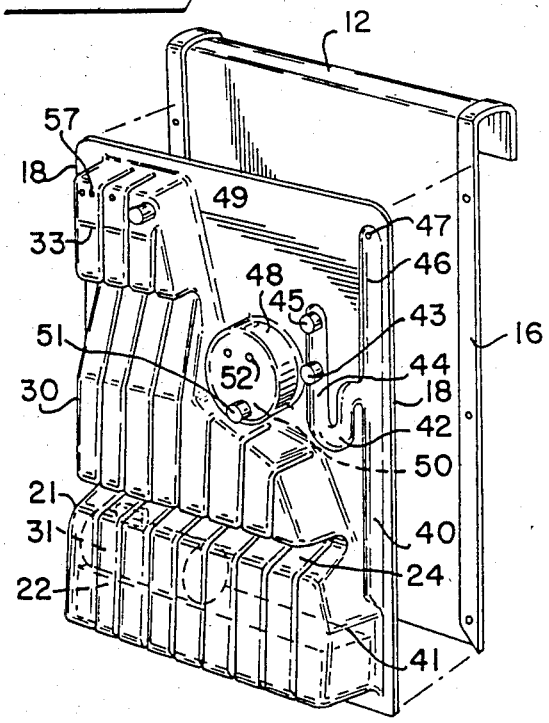
FIG. 2 is a perspective view of a dispenser.

The concepts of this invention contemplate the use of a dispenser which may be of the type illustrated in the aforementioned Meloy applications. The drawings illustrate a dispenser 20 of the type associated with a toilet tank 10. In the embodiment shown, a hanger 12 is employed for suspending the dispenser on the back wall 14 of the tank. As best shown in FIG. 2, the hanger defines overturned side edges 16 which form channels adapted to receive the side edges 18 of the dispenser. The dispenser slides relative to the hanger and frictional engagement between the respective edges enables a homeowner to select the relative positions of the dispenser and hanger during use to accommodate particular conditions.

It will be appreciated that other means could be provided for locating a dispenser in a tank to achieve the purposes of the invention. As already indicated, other dispensers of various design may also be used when practicing this invention including dispensers designed for other applications such as for treating swimming pools and waste treatment facilities.

The dispensing apparatus 20 is positioned in the toilet tank at a level that coincides with water level indicator mark 33 provided on the front wall of the dispenser.

The apparatus comprises three chambers, including a reservoir chamber 21 which contains solid disinfectant 22 and a solid color signal ingredient 31. A baffle means 24 defines the top of this reservoir chamber.

A volume control chamber 30 is in fluid communication with chamber 21 and is provided with air vent means 49, pinhole vent means 57, and the aforementioned water level line 33.

A delivery tube 40 is in fluid communication with reservoir chamber 21. This tube communicates with this chamber through narrow passage 41 which is located adjacent the end of baffle means 24.

A conduit 42 extends outwardly from one side of the tube 40, and the conduit includes an upwardly extending portion 44. An opening is adapted to be formed at either 43 or 45 in this extension 44 to provide access to the toilet tank water. These openings in combination with water level line 33 cooperate to make the dispenser responsive to the contaminants present in the tank and bowl and to maintain the disinfectant at an effective level.

As best shown in FIG. 2, the openings 43 and 45 are initially closed because the plastic molding operation preferably used in the manufacture of the invention leaves a plastic cap or film over these openings. The user of the construction then has the option of clipping off one or the other of these caps. It has been found that where a system has a high staining potential, the lower cap 43 is preferably clipped off to thereby increase the dosage of a given flush and maintain the disinfectant at an effective level. A lesser dosage is achieved by using the higher opening shown at 45.

The delivery tube 40 also includes a standpipe portion 46. The upper end of this standpipe defines an air vent opening 47 which could be left open during manufacturing or which could also be opened as part of the instructions to the user. The standpipe and associated air vent insure continuous operation of the apparatus free from any air lock.

A third chamber 48 may also be utilized to assist in maintaining the disinfectant at effective levels. This chamber 48 is independent of the other chambers and may, for example, house a sequestering or chelating agent 50 adapted to be dispensed through opening 51 defined by the chamber 48. The opening 51 is preferably covered by a cap or film in the course of the manufacturing operation so that the contents of chamber 48 can be selectively used. Pinhole vent means 52 are provided to permit intake and expelling of air during use.

Figure 4:
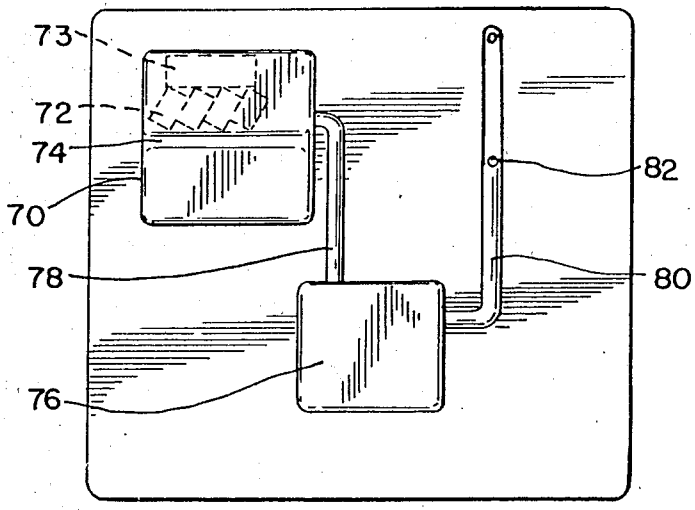
FIG. 4 is an elevational view of an additional alternative form of dispenser.
Figure 3:
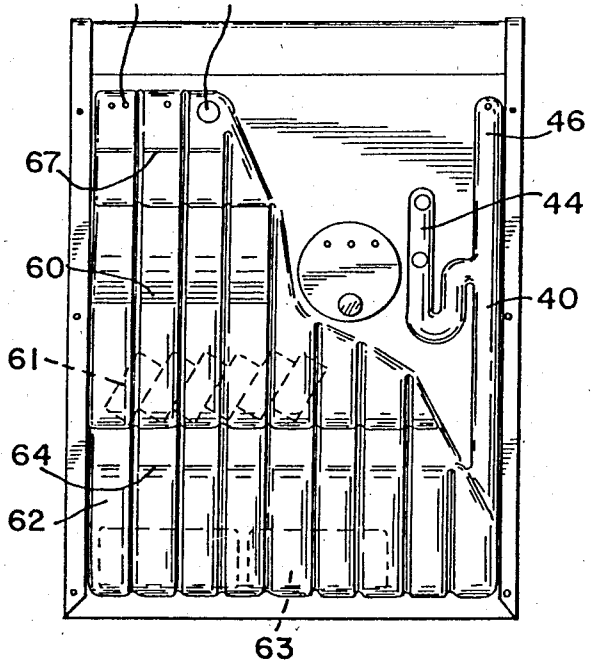
FIG. 3 is an elevational view of an alternative form of dispenser.

Alternative arrangements for locating the color signal and disinfecting ingredients in a dispenser are shown in FIGS. 3 and 4.

In FIG. 3, solid disinfectant 61 is located in volume control chamber 60, and this chamber is in fluid communication with reservoir chamber 62 which contains a solid color signal ingredient 63 positioned immediately below baffle 64. The chamber 60 is also provided with air vent means 65, pinhole vent means 66 and a water level line 67. Except for the translocation of the disinfecting ingredient to the volume control chamber, this dispenser functions similar to that shown in FIG. 2 above.

The construction of FIG. 4 comprises a reservoir chamber 70 which contains color signal tablets 72 and cleaning and disinfecting ingredient 73, located above baffle 74. The chamber 70 is in fluid communication with chamber 76 through conduit 78. The chamber 76 in turn communicates through conduit 80 with fluid inlet port 82.

Upon immersion of the structure of FIG. 4, tank fluid or the like will enter through port 82, and pass into chambers 70 and 76. A concentrated solution of the cleaning and disinfecting ingredient will pass from chamber 70 into chamber 76 and out through port 82 under appropriate conditions. Such conditions would comprise, for example, flushing of a toilet wherein the water level drops below the level of the chambers provided in the device.

The concentrated solution passing into chamber 76 will also contain the color signal ingredient; however, the color signal containing solution will be bleached so that no color will appear in the discharge from chamber 76 until the cleaning and disinfecting ingredient has been depleted.

It will be appreciated that the arrangements of FIGS. 2, 3 and 4 are illustrated in this application primarily for purposes of establishing that the composition and method of this invention may be utilized in a variety of different systems.

The present invention specifically provides a method and composition for monitoring the concentration of a cleaning or disinfecting ingredient, such as the ingredient 22 located in the chamber 21 of the dispenser 20. This object may be achieved, e.g., where the ingredient results in an aqueous hypochlorite mixture, and preferably wherein the aqueous hypochlorite mixture also contains calcium.

As noted, this invention in particular relates to a color indicator characterized by controlled release in the environment of a cleaning and disinfecting ingredient such as a hypochlorite. The color indicator comprises a solubilizing agent, a matrix agent, and a dye ingredient for indicating color. The indicator is preferably in the form of a solid tablet or cake with structural integrity, the indicator having been compressed at e.g., from between about 5,000 lbs. and about 25,000 lbs. of die pressure. The compositions are so constructed that they generally retain their shape and size while continuously releasing a solubilizng agent and a color indicator.

The composition comprises:

(a) From between about 30 and 85 percent by weight of a solubilizing agent selected from the group consisting of alkali and alkaline earth metal salts and mixtures thereof. In a preferred embodiment, the solubilizing agent comprises from between about 60 and 80 percent by weight sodium chloride with at least 50 percent by weight of the sodium chloride or the like having a mesh size between about 30 and about 100 prior to blending with the other ingredients.

(b) From between about 5 and about 40 percent by weight of a matrix agent selected from the group consisting of alkali metal stearates and mixtures thereof. In a preferred embodiment, the matrix agent comprises from between about 10 and 30 percent by weight sodium stearate. It is further preferred that a substantial portion of the matrix agent is of a particle size at least as small as 100 mesh in order to facilitate distribution of the matrix agent in the composition.

(c) From between about 2 and about 20 percent by weight of a color indicator selected from the group consisting of a hypochlorite stable arylmethane dye and mixtures thereof. In accordance with preferred embodiments of the invention, the color indicator comprises from between about 5 and about 15 percent by weight of a dye selected from the group consisting of FD & C Blue #1, FD & C Green #3, Intracid Pure Blue V, and mixtures thereof.

In addition to use with the dispensers illustrated, the composition may be used in conjunction with other dispensers, e.g., as described in McDuffee U.S. Pat. No. 3,837,017, or of the type used for chlorinating swimming pools, waste treatment facilities and the like. In the case of the McDuffee dispenser, one or more tablets of the composition of the invention are mixed with the other ingredients, and these indicate when a suitable amount of hypochlorite is no longer being dispensed. It will be apparent when considering the operation of McDuffee, that the composition of the invention being present with the calcium hypochlorite will release color indicator regularly as the hypochlorite is dispensed from the McDuffee container into the toilet. The color indicator will be bleached for as long as significant amounts of the hypochloride are present.

In a preferred embodiment of the invention, the color indicator tablets or the like are coated with a protective coating comprising a shellac, a lacquer, or mixtures thereof. The coating will:

(a) protect the compositions of the invention from air, humidity, etc.

(b) minimize dusting and make handling easier, and (c) delay the wetting of the composition when it is immersed in a container containing calcium hypochlorite. This delayed wetting is most useful where solubilization of the calcium hypochloride is delayed and or where the color indictor tablet is expected to be subjected to bleaching action for a prolonged period.

It is further preferred that a binder be added to the composition to assist in maintaining the physical integrity of the tablet. This binder may be any of a number of known, commercially available binders, such as microcrystalline cellulose.

As suggested, compositions of the invention can be conveniently pressed into a cake-like structure taking the form of a tablet, pellet, sphere, or other solid material shape. Such forms can be made by extrusion, by hydraulic stamping, or by pouring a melt of the composition into a mold and solidifying the composition by cooling, provided the critical porosity defined below is obtained.

With reference to this critical porosity, it has been observed that there is a correlation between the porosity of a tablet or the like and the rate of controlled release in a bleach solution of the hypochlorite stable color indicator and the duration of physical integrity of the tablet. Porosity for the purposes of the present invention is defined as the volume percentage of a petroleum distillate such as kerosene which is absorbed by the tablet under test conditions. This porosity may be further described as the controlled release structure developed in the tablet, this structure comprising a labryinth of channels and passageways that are created when the blend of solubilizing agent, matrix agent and color indicator are compressed under various conditions such as described in Table I below.

Tests for determining porosity may be carried out by dropping uncoated tablets weighed to the nearest 0.01 g into approximately 9 cc odorless kerosene (Fisher K-10) contained in a 25 ml graduated cylinder. A reading is promptly taken on the graduated cylinder before appreciable absorption has had time to occur. Density is then determined by using the following equation:

$$\text{density (g/cc)} = \frac{\text{weight tablets, g.}}{\text{final vol. (cc)} - \text{initial vol. (cc)}}$$

Uncoated tablets are then weighed to the nearest 0.01 g, immersed in odorless kerosene (Fisher K-10), and subjected to water aspirator vacuum for 15 minutes or allowed to stand at atmospheric pressure for two hours. The liquid is decanted and excess surface liquid removed. Final weight is then determined to the nearest 0.01 g and the porosity determined using the following equation:

$$\text{Porosity (\% void by vol.)} = \frac{\dfrac{\text{final wt. (g)} - \text{Initial wt. (g)}}{\text{Kerosene density (g/cc)}}}{\dfrac{\text{Initial wt. (g)}}{\text{tablet density (g/cc)}}} \times 100$$

In accordance with the invention, the porosity of the tablets is 10% or less by volume and preferably between about 4% and 8% by volume. It has been found that when the porosity of tablets is excessive, then the controlled rate of release of the color indicator is not obtained and the tablet can be exhausted of color indicator or may disintegrate before the bleach concentration of the aqueous bleach medium being monitored falls below an effective level. In such cases, a tablet may become exhausted of color in less than 30 days, which will ordinarily be prior to the exhaustion of the toilet bowl cleaner being monitored.

The following Table I provides examples of suitable compositions, it being understood that reference may be made to the aforementioned Meloy applications for other examples. The porosity of the tablets suitable for the invention can be obtained by a combination of elements including processing variables and composition variables. An example of preferred conditions for making tablets of the present invention and tablets suitable for use in the method of the present invention is found in the Example below.

TABLE I

| Example | Color Indicator % by Wt. | Solubilizing Agent % by Wt. | Matrix Agent % by Wt. | Compression In Lbs. |
|---|---|---|---|---|
| I | Intracid Blue V/10 | NaCl/70 | Sodium Stearate/20 | 5,000 |
| II | Intracid Blue V/5 | NaCl/70 | Sodium Stearate/25 | 10,000 |
| III | Intracid Blue V/2 | NaCl/70 | Sodium Stearate/28 | 20,000 |
| IV | Intracid Blue V/20 | KCl/40 | Sodium Stearate/40 | 15,000 |
| V | Intracid Blue V/15 | KCl/80 | Sodium Stearate/5 | 25,000 |
| VI | Intracid Blue V/8 | KCl/72 | Sodium Stearate/20 | 25,000 |
| VII | FD & C Green #3/10 | NaCl/70 | Sodium Stearate/20 | 15,000 |
| VIII | FD & C Green #3/5 | NaCl/70 | Sodium Stearate/25 | 10,000 |
| IX | FD & C Green #3/2 | NaCl/70 | Sodium Stearate/28 | 15,000 |
| X | FD & C Green #3/20 | KCl/40 | Sodium Stearate/40 | 20,000 |
| XI | FD & C Green #3/15 | KCl/80 | Sodium Stearate/5 | 25,000 |
| XII | FD & C | KCl/72 | Sodium | 15,000 |

TABLE I-continued

| Example | Color Indicator % by Wt. | Solubilizing Agent % by Wt. | Matrix Agent % by Wt. | Compression In Lbs. |
|---|---|---|---|---|
| | Green #3 | | Stearate/20 | |

The processing tests conducted have confirmed a critical porosity for the tablets of the invention of less than about 10% and preferably between about 4 and about 8% by volume. Since this critical porosity is a function of processing variables such as presure, development time, dwell time, type of press and formulation variables, such as mesh size of the solubilizing agent and type of concentration of matrix and solubilizing agent, the desired porosity can be obtained by a combination of one or more of these. It has been determined, however, that the tablet should be manually or machine-pressed at pressures between 2.5 and 12.5 tons per square inch to densities between 1 and 2.25 grams per cubic centimeter.

The duration of the stable color indicator tablet in various bleach solutions is a function of the critical porosity and the tablet size. Thus, if durations from 30 to 120 days are required in various toilet tank chlorinating dispensers, a spherical tablet of between about ½ inch and 1 inch in diameter with a critical porosity of about 7% by volume is optimum. In contrast, when a chlorinator in a waste treatment facility is being monitored for time spans ranging up to about one year, it is suggested that a spherical tablet approximately 3 inches in diameter with a critical porosity of about 5% by volume would be suitable. Swimming pool monitors of approximately the same size will generally last a season.

EXAMPLE

FD & C Green #3 dye (8 lbs.) and sodium stearate (16 lbs.), having a particle size such that 93 % would pass thru 100 mesh, were placed in a vaned rotary drum mixer and mixed for 5 minutes. Sodium chloride (54.4 lbs.) was added, and mixing continued. After 2 minutes microcrystalline cellulose (1.6 lbs.) was added and mixing continued for 6 minutes. This resulted in a homogeneous powder which was pressed into 3 gram, 9/16"×9/16" tablets on a rotary tablet press at a pressure of approximately 17,000 lbs. The tablets were dusted with sodium stearate and coated 3 to 4 times with shellac.

It will be understood that various changes and modifications may be made in the above-described invention without departing from the spirit thereof as defined in the following claims.

I claim:

1. In a method for detecting the depletion of a cleaning and disinfectant ingredient in a solution initially containing the ingredient, comprising the steps of locating said ingredient in a dispenser, positioning said dispenser in said solution, locating a solid composition in the dispenser adjacent said ingredient while providing communication within the dispenser between the respective locations of said ingredient and said composition, said composition having a critical porosity from between about 1 to about 10% by volume and comprising a color indicator, and a matrix supporting the color indicator and permitting gradual release of the indicator, amounts of said solution being introduced into said dispenser for contact in the dispenser with both said ingredient and said composition, said ingredient and said indicator being gradually released into the solution whereby a concentrated solution of said ingredient and said indicator is formed in the dispenser, said ingredient having a bleaching tendency relative to said color indicator whereby the presence of the ingredient in the solution minimizes the display of color in the solution for as long as significant amounts of said ingredient are present, and whereby solution released from the dispenser is substantially free of color, and wherein continued release of said color indicator after depletion of said ingredient results in a substantial display of color in solution released from the dispenser whereby the depletion of said ingredient can be detected.

2. A method in accordance with claim 1 wherein said solution comprises the solution present in a toilet tank, flushing of the toilet resulting in the presence of said ingredient and said composition in both the toilet tank and the bowl, said display of color occuring in the toilet bowl upon depletion of said ingredient.

3. A method in accordance with claim 1 wherein said ingredient comprises a hypochlorite, and wherein said composition comprises:

(a) from between about 30 and about 85 percent by weight of a solubilizing agent selected from the group consisting of alkali and alkaline earth metal salts and mixtures thereof;

(b) from between about 5 and about 40 percent by weight of a matrix agent selected from the group consisting of alkali metal stearates and mixtures thereof, and (c) from between about 2 and about 20 percent by weight of a color indicator selected from the group consisting of hypochlorite stable, arylmethane dyes and mixtures thereof.

4. A method in accordance with claim 3 wherein said composition comprises about 70 percent by weight sodium chloride, about 20 percent by weight sodium stearate, and about 10 percent by weight color indicator.

5. A method in accordance with claim 3 wherein said solubilizing agent, said matrix agent, and said color indicator are compressed into a cake-like structure at pressures between about 2.5 tons and 12.5 tons per square inch.

6. A method in accordance with claim 5 including the step of providing a protective coating around said cake-like structure, said coating comprising a material selected from the group consisting of shellacs, lacquers, and mixtures thereof.

7. A method in accordance with claim 3 wherein said color indicator is selected from the group of dyes consisting of FD & C Green #3, FD & C Blue #1, Intracid Pure Blue V, and mixtures thereof.

* * * * *